US007735406B1

(12) United States Patent
Olson

(10) Patent No.: US 7,735,406 B1
(45) Date of Patent: Jun. 15, 2010

(54) LATCH FOR SUPPRESSOR

(75) Inventor: Douglas D. Olson, Huntsville, AR (US)

(73) Assignee: Wilsons Gun Shop, Inc, Berryville, AR (US)

( * ) Notice: Subject to any disclaimer, the term of this patent is extended or adjusted under 35 U.S.C. 154(b) by 391 days.

(21) Appl. No.: 11/998,133

(22) Filed: Nov. 29, 2007

(51) Int. Cl.
*F41A 21/30* (2006.01)

(52) U.S. Cl. ..... 89/14.3

(58) Field of Classification Search ..... 89/14.1–14.6; 42/79, 85, 86, 97
See application file for complete search history.

(56) References Cited

U.S. PATENT DOCUMENTS 1,143,814 A * 6/1915 De Vries ..... 181/223
2,663,961 A * 12/1953 White et al. ..... 42/79
3,698,747 A * 10/1972 Wing et al. ..... 285/305
3,797,155 A * 3/1974 Smith et al. ..... 42/79
4,510,843 A 4/1985 Rabatin
5,685,102 A * 11/1997 Latka ..... 42/85
5,773,746 A * 6/1998 Vaden ..... 89/14.4
6,385,891 B1 * 5/2002 Rabatin ..... 42/79
2001/0049996 A1 * 12/2001 Fluhr ..... 89/14.4
2002/0121040 A1 * 9/2002 Kumler ..... 42/79
2007/0095198 A1 * 5/2007 Dater et al. ..... 89/14.2

FOREIGN PATENT DOCUMENTS

GB 2242476 10/1991
WO WO 2007069086 A2 6/2007

* cited by examiner

*Primary Examiner*—Bret Hayes
*Assistant Examiner*—Reginald Tillman, Jr.

(57) ABSTRACT

A latch for mounting a suppressor to a firearm is disclosed that allows interfacing with and securely attaching to the weapon's flash hider without the need to use threads and the rotational movement commonly associated with attaching suppressors to a firearm. The latch consists of a primary latch and a secondary latch. The primary latch moves in a vertical plane, fits into the grooves on a standard flash hider, and is rotationally indexed to the flash hider when locked. The secondary latch attaches to the top of the primary latch, securing the primary latch when it is fully locked by pivoting around and downwards, and locking to the suppressor. The primary latch compensates for the considerable tolerance range of the outside diameter of the flash hider. The latch has minimal thermal coupling to the suppressor and engaging/disengaging the primary latch plate and the secondary latch can be accomplished with one hand.

22 Claims, 7 Drawing Sheets

LATCH FOR SUPPRESSOR

BACKGROUND OF THE INVENTION

1. Field of the Invention

This application relates broadly to mounting systems for sound suppressors for firearms. More particularly, it concerns an improved latch system for sound suppressors for use with M4 Series Carbines, M16 Series rifles and other military and commercial automatic, semi-automatic and bolt action firearms.

2. Description of the Prior Art

The M4 Series Carbine and the M16 Series Rifles all use a common flash hider that has some considerable tolerance range for its outside diameter. This tolerance is a major factor in ensuring proper alignment occurs with the bore thru the suppressor baffles and the actual path of the projectile as it travels thru this bore when a sound suppressor is attached to the flash hider by various means. As a result of this tolerance factor, the bore hole through the suppressor usually has to be enlarged when compared to a suppressor using a screw thread attachment method or a proprietary flash hider using much tighter tolerances on the outside diameter of the proprietary flash hider. A number of different mounting systems that allow attachment of a sound suppressor to the standard M4 Series Carbine, M16 Series Rifle and commercial equivalent style flash hiders are known. However, they all have problems including the length of time it takes to attach/detach the suppressor from the flash hider, excessive steps or movements to attach/detach the suppressor, poor support and insufficient bearing surfaces of the mount interface to the flash hider, inability to remove when the suppressor is hot, and excessive thermal transfer to the latch from the mount and the suppressor body. U.S. Pat. No. 4,510,843 (Rabatin) discloses the use of a cam-operated system that compressed lugs on an integral collet into the two grooves on the flash hider common to both M4 Series Carbines and M16 Series Rifles. The main problem with this system is that the collet fingers are basically a form of flat spring and because they surround and are in direct contact with the flash hider, there is considerable transfer of heat to the collet fingers. During prolonged weapon firing the temperature of the collet fingers reaches a point, which is dictated by their heat treatment and metallurgical properties, where the spring characteristics of the collet fingers will become reduced resulting in failure of the fingers to retract out of the flash hider and thus locking the suppressor to the firearm. Rabatin used a gas tube positioned inside the flash hider in an attempt to minimize the effects of heat on the collet fingers. In a second U.S. Pat. No. 6,385,891, Rabatin used a conical pilot in yet another attempt to minimize the effects of gases on the collet fingers. U.S. Pat. No. 5,773,746 (Vaden) disclosed the use of three pivoting fingers that are locked into position by the use of two rotating collars, one positioned on the outside of the mount and the other on the inside. The main problem with the Vaden approach is the inability to activate the lock when the suppressor is hot without the use of special tools or heat resistant materials to protect the operator's hands. Additionally Vaden utilizes a long thread engagement on the rotating collars so it takes considerable motion and time to lock/unlock the system. G.B. Patent 2242476 (Felton) disclosed a mounting system that used a U-shaped cut-out in a locking collar to accommodate various flash hiders including the M4 Series Carbine and M16 Series Rifle flash hider. The collar was tightened against the rear of the flash hider by tightening up the suppressor and the collar to the sound suppressor against the front end of the flash hider. While this mount is secure, the three main problems are the excessive time to attach/detach, the inability to remove a hot suppressor without tools or thermal protection for the operator and the collar being a separate part which is therefore prone to loss. WO 2007/069086 (Brugger) discloses a mounting system that uses a locking gate coupled with a rotation lock and a gate lock to secure the sound suppressor to a flash hider or modified barrel. The problem with this mounting system is that the steps to mount and dismount the suppressor are numerous. First a rotation lock has to be pushed rearward and then the suppressor is rotated about three turns to disengage the suppressor from the mount. Next a gate lock is then pushed forward to disengage a lock pin from the gate, with the gate then being lifted upwards. The suppressor is then slid over the flash hider and the gate is then pushed down and the gate lock is then reengaged. The suppressor is then rotated to lock the suppressor against the front of the flash hider. These many steps are repeated in reverse order to dismount the suppressor.

The present invention solves these problems by the provision of a latch mounting system for use with an M4 Series Carbine, M16 Series Rifle or commercial equivalent rifle that uses a primary latch plate that moves in a vertical plane in conjunction with a secondary latch that pivots about a point on the primary latch plate and produces a downward locking force to secure the primary latch plate to the flash hider. The primary latch interfaces with and locks into the two circular grooves on the M4 Series Carbine, M16 Series Rifle or commercial equivalent flash hider while at the same time indexing the suppressor rotationally against one of the wrench flats on that flash hider. For the secondary latch to engage, the primary latch must be in its fully down position. The secondary latch rotates around a pivot pin which is anchored to the primary latch and mirror image protruding surfaces mate with a path machined into the suppressor's rear support, causing the lower arms of the secondary latch to deflect downward as the protruding surfaces rotate past center and then lock into a small depression machined as part of said path. A small captive compression spring in the vertical primary latch plate applies a force against the flash hider as the primary latch plate is pushed downward; biasing the flash hider towards the bores in the rear and front supports which interface with the flash hider. The force applied by the spring is sufficient to hold the entire suppressor in this biased attitude and thus takes up any diametrical clearance between the flash hider and the bore for the flash hider within the sound suppressor. While the centerline of the flash hider and the centerline of the suppressor are slightly offset, there is minimal angular deviation between these two centerlines. Thus the front of the suppressor does not droop downward due to the effects of gravity which, if it occurred, would necessitate having a larger bore thru the suppressor to prevent the projectiles that pass thru it from striking said bore.

The present invention also solved a problem that exists with the Knight's Armament M4QD and NT4 suppressors. The latch plates on those suppressors move vertically to unlock from a special flash hider. In their fully unlocked position, these latch plates can pivot to a sufficient angle relative to the vertical track within the suppressor such that the latch plate wedges, inhibiting its downward movement. By cutting the track lower into the suppressor and making the latch plate longer, the current design can no longer deflect far enough off axis to its vertical track to bind and thus inhibit its downward travel as locking occurs.

OBJECTS

A principal object of the invention is to provide the operator with a latch system for a suppressor that attaches to an M4

Series Carbine, M16 Series Rifle, or their commercial equivalent firearm that is fast, reliable and does not require any modifications to the rifle. The latch system provides a method of attaching a suppressor to these Carbines and Rifles by interfacing with and securely attaching to the weapon's flash hider without the need to use threads and the rotational movement commonly associated with attaching suppressors to a firearm.

A further object is to provide a latch system that allows for the considerable outside diameter tolerance of the M4 Series Carbine, M16 Series Rifle and their commercial equivalent flash hiders yet at the same time ensures that when attached, the latch minimizes the angular deviation between the center line of the flash hider and the center line of the mating bore within the suppressor. The result of this is that a smaller bore thru the baffles within the suppressor is allowed with a resultant improvement in the sound reduction capabilities of the suppressor.

Yet another object is to provide a latch system for a suppressor that attaches to an M4 Series Carbine, M16 Series Rifle or commercial equivalent firearm that has minimal thermal coupling to the suppressor body. The primary latch plate and the secondary latch are kept cool by limiting the physical contact between them and the rest of the suppressor and the firearm's flash hider. In addition, there is little physical contact that the shooter must make with the secondary latch as he opens the primary latch plate. Thus it becomes possible to remove a hot suppressor without requiring the shooter to use some form of thermal protection for his hands.

Yet another object is to provide a latch system for a suppressor that provides for rotationally indexing the suppressor while attaching it to the M4 Series Carbine, the M16 Series Rifle or their commercial equivalent firearm without the use of threads. The indexing feature also limits rotational movement of the suppressor when the suppressor is attached to the host firearm.

Yet another object is to provide sufficient support for the primary latch so that when it is in the un-latched position it will not wedge in the vertical track and thus have its downward motion inhibited.

Other objects and further scope of applicability of the present invention will become apparent from the detailed descriptions given herein; it should be understood however, that the detailed descriptions, while an indication of preferred embodiments of the invention, are given by way of illustration only, since various changes and modifications within the spirit and scope of the invention will become apparent from such descriptions.

SUMMARY OF THE INVENTION

The objects are accomplished in accordance with the invention by the provision of unique improvements for sound suppressors for M4 Series Carbines, M16 Series Rifles and their commercial equivalent firearms that comprise:

(a) a latching system that primarily moves in a vertical plane and engages the standard issue flash hider of the M4 Series Carbine, the M16 Series Rifle and their commercial equivalent firearms in a fast and secure manner. The acts of engaging and opening the latch require minimal steps and movements by the operator.

(b) a secondary latch that secures the primary latch plate in its fully down position which has minimal thermal coupling to the primary latch plate and to the other suppressor components. The act of disengaging the latch system is a simple rotate and lift motion. The acts of engaging and disengaging the primary latch plate and the secondary latch can be accomplished with one hand.

(c) a primary latch plate that compensates for the considerable tolerance range of the outside diameter of the M4 Series Carbine, the M16 Series Rifle and their commercial equivalent firearms standard flash hider. The primary latch holds a compression spring to force the suppressor into intimate contact with the flash hider towards the side of the mating bore within the suppressor mount opposite the spring. Taking up the diametrical clearance between the flash hider and the mount bore results in minimizing the angular deviation between the flash hider and the bore of the suppressor. As a result the bore thru the baffles in the suppressor can be reduced in size, enhancing the sound reduction capabilities of the suppressor.

(d) a primary latch plate that rotationally indexes to the flash hider when attached and thus limits rotational movement of the suppressor to that allowed by tolerances only. The vertically moving primary latch plate has a protruding surface on one side of the latch plate that interfaces with one of the wrench flats that are machined into the standard M4 Series Carbine, the M16 Series Rifle and their commercial equivalent firearms flash hider. These wrench flats are used to attach the flash hider to the rifle and when the flash hider is attached correctly to the rifle, these wrench flats are oriented in a position that is vertical to the axis of the bore of the rifle. When the vertical primary latch plate is pushed down to its fully down position, the protruding surface abuts one of the wrench flats and thus indexes the suppressor to the flash hider. This indexing limits the rotational movement of the suppressor in relation to the flash hider.

(e) a primary latch plate that is supported well enough in its fully unlocked position such that it can not move sufficiently off of the vertical axis of the track for the latch plate within the suppressor such that its downward movement can become inhibited. By lengthening the latch plate and providing for that extra length in the portion of the track that is below the centerline of the suppressor, the latch plate is much better constrained in its fully unlocked position.

A first unique improvement provided by the invention is a mounting system that moves in a vertical plane to the axis of the firearm, provides a fast, secure and reliable method of attaching a sound suppressor to a rifle and requires minimal physical movement to attach or detach the suppressor. No multiple rotational movements of the suppressor or parts of the mount are required to attach or detach the suppressor with this latching system.

A second unique improvement is to provide a latch system that has minimal thermal coupling to the suppressor due to the fact that the locking components of the latch have minimal surface contact with the suppressor. Part of the rear face of the primary latch plate is in direct contact with part of the rear face of the vertical track in the suppressor. This contact is primarily along the sides of the track. The sides of the latch have occasional contact with the sides of the track. This surface to surface contact is minimized because of the vertical track. With the secondary latch attached to the primary latch itself via a pivot pin and straddling a boss, it has little direct contact with the primary latch plate thru which it can conduct heat out of the primary latch plate. The secondary latch has only two small projections that interface directly with the suppressor body plus there is some incidental surface contact depending on the relative location of the parts and their tolerances. As a result, the secondary latch absorbs relatively little heat from the suppressor by direct thermal conductance. It of course receives some radiated heat from the suppressor but it still remains one of the coolest parts of the suppressor. Since the operator only needs to contact the secondary latch to unlock the suppressor from the flash hider, he remains insulated from the majority of the heat absorbed by the suppressor during firing.

A third unique improvement is the ability to compensate for the tolerances of the standard flash hider used on the M4 Series Carbine, the M16 Series Rifle and their commercial equivalent firearms. This ensures that a tighter bore through the baffles within the suppressor is possible, thereby enhancing the sound reduction potential of the suppressor. This is achieved through the use of a simple compression spring that acts upon the flash hider in relation to the bore of the suppressor mount. As the primary latch plate is pressed down into the two grooves in the flash hider, a spring is compressed on the inside of the primary latch thus biasing the bore of the mount in the suppressor against the outside diameter of the flash hider. This means that any diametrical clearance between the flash hider and the bore of the suppressor is taken up by the spring, resulting in the minimization of the angular deviation between the center line of the flash hider and the center line of the bore through the suppressor.

A fourth unique improvement is that the suppressor is rotationally indexed to the flash hider when attached, thus limiting the amount of rotational movement of the suppressor. The vertical primary latch has a protruding surface on one side that interfaces with one of the wrench flats that are machined into the standard flash hider for the M4 Series Carbine, the M16 Series Rifle and their commercial equivalents. These wrench flats are used to tighten the flash hider onto the rifle and when the flash hider is attached correctly to the rifle, these wrench flats are oriented in a position that is vertical to the axis of the bore of the rifle. When the vertical primary latch plate is pushed down to its fully down position, the protruding surface abuts one of the wrench flats and thus rotationally indexes the suppressor to the flash hider.

A fifth unique improvement is that the primary latch plate is supported well enough in its fully unlocked position such that it cannot move far enough off of the axis of the track for the latch plate within the suppressor for the primary latch plate to wedge in place, inhibiting its downward movement. The primary latch plate was designed such that the straight portion of the legs extend below the centerline of the suppressor and necessary clearance was provided in the recess machined into the suppressor for accommodate those longer legs. As a result the primary latch plate is much better constrained within the track when in its fully unlocked position.

BRIEF DESCRIPTION OF THE DRAWINGS

A more complete understanding of the invention can be obtained by reference to the accompanying drawings wherein generic parts of the illustrated matter are indicated by arrowhead lines associated with the designation numerals while specific parts are indicated by plain lines and wherein.

DESCRIPTION OF PREFERRED EMBODIMENTS

Figure 1:
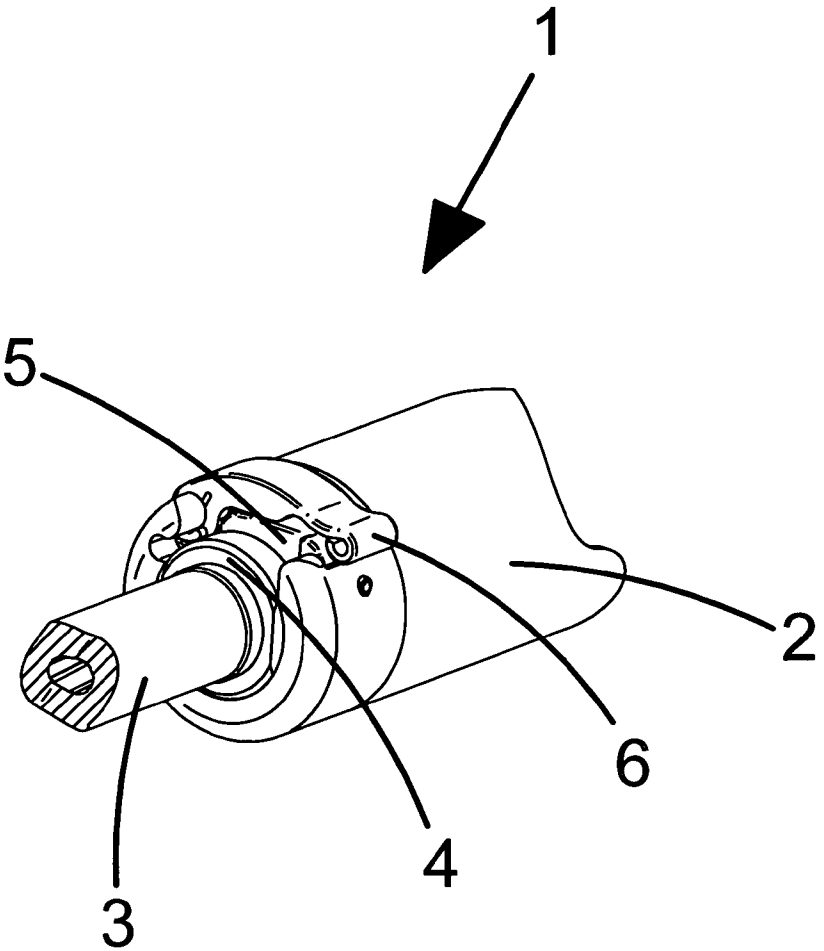
FIG. 1 is an isometric view of the latch portion of a suppressor shown fully locked onto a barrel mounted flash hider.

Referring in detail to FIG. 1 of the drawings, suppressor latch assembly 1 is shown in the fully latched condition. Suppressor body assembly 2 surrounds flash hider 4 which is attached to firearm barrel 3. Primary latch plate 5 is in the fully latched position as is secondary latch 6. In this position flash hider 4 is restrained from withdrawing from suppressor body assembly 2 by primary latch plate 5.

Figure 2:
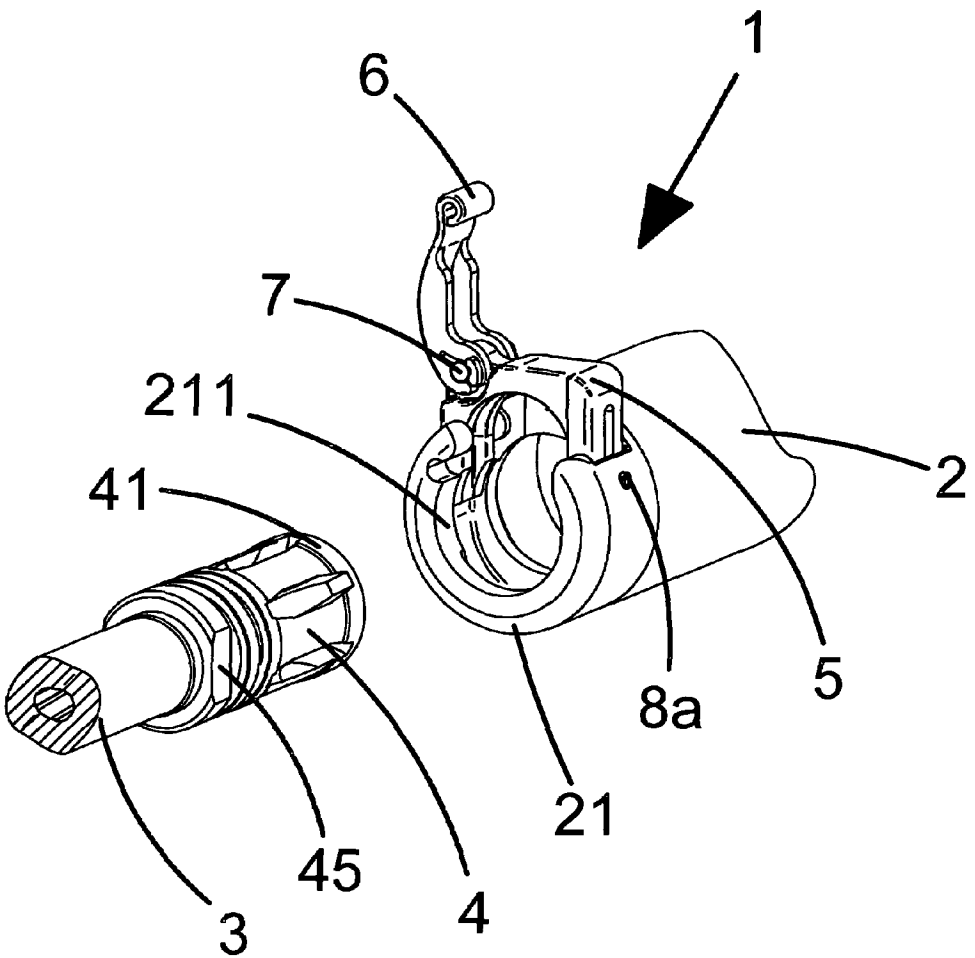
FIG. 2 is an isometric partially exploded view of the suppressor latch assembly in the unlatched position and the flash hider withdrawn from the suppressor.

Referring in detail to FIG. 2 of the drawings, when secondary latch 6 has been rotated approximately ninety degrees about pivot pin 7, primary latch plate 5 can be lifted until latch retaining pins 8*a* and 8*b* (see FIG. 3) stops its travel. In this position flash hider 4 can be withdrawn from or seated into suppressor body assembly 2. Rear support 21 of suppressor body assembly 2 contains bore 211 which is of a size to accept outside diameter 41 of flash hider 4. Wrench flat 45 on flash hider 4 is intended to be mounted vertically in relation to the firearm upon which it is mounted.

Figure 3:
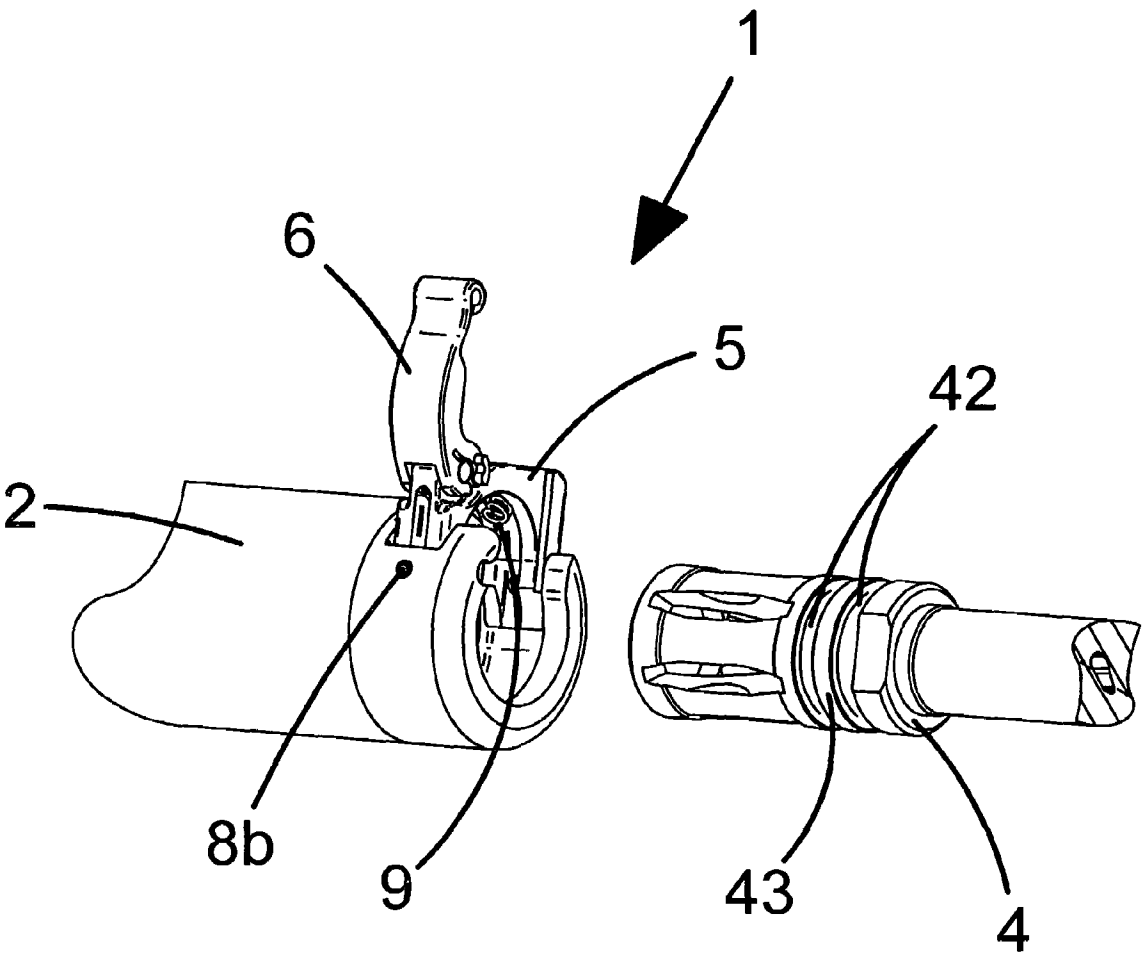
FIG. 3 is another isometric view from a second perspective point of the suppressor latch assembly in the unlatched position and flash hider withdrawn from the suppressor.
Figure 6:
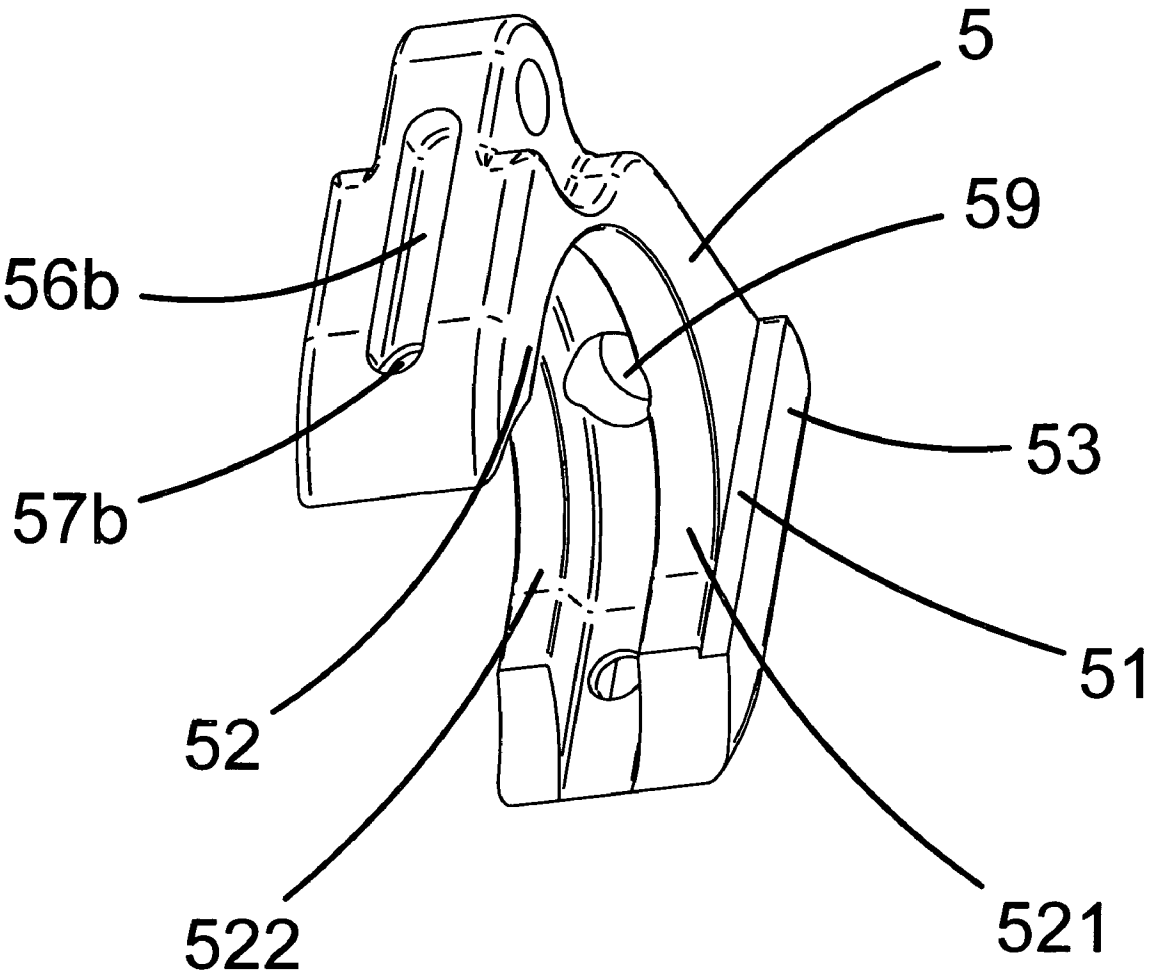
FIG. 6 is a second isometric view of the primary latch from another aspect point.

Referring in detail to FIG. 3 of the drawings, spring 9 is captive within pocket 59 in primary latch 5 (see FIG. 6). The spring presses against ring 43 which separates the two grooves 42 in flash hider 4. Grooves 42 in flash hider 4 provide the locking surfaces for primary latch 5.

Figure 4:
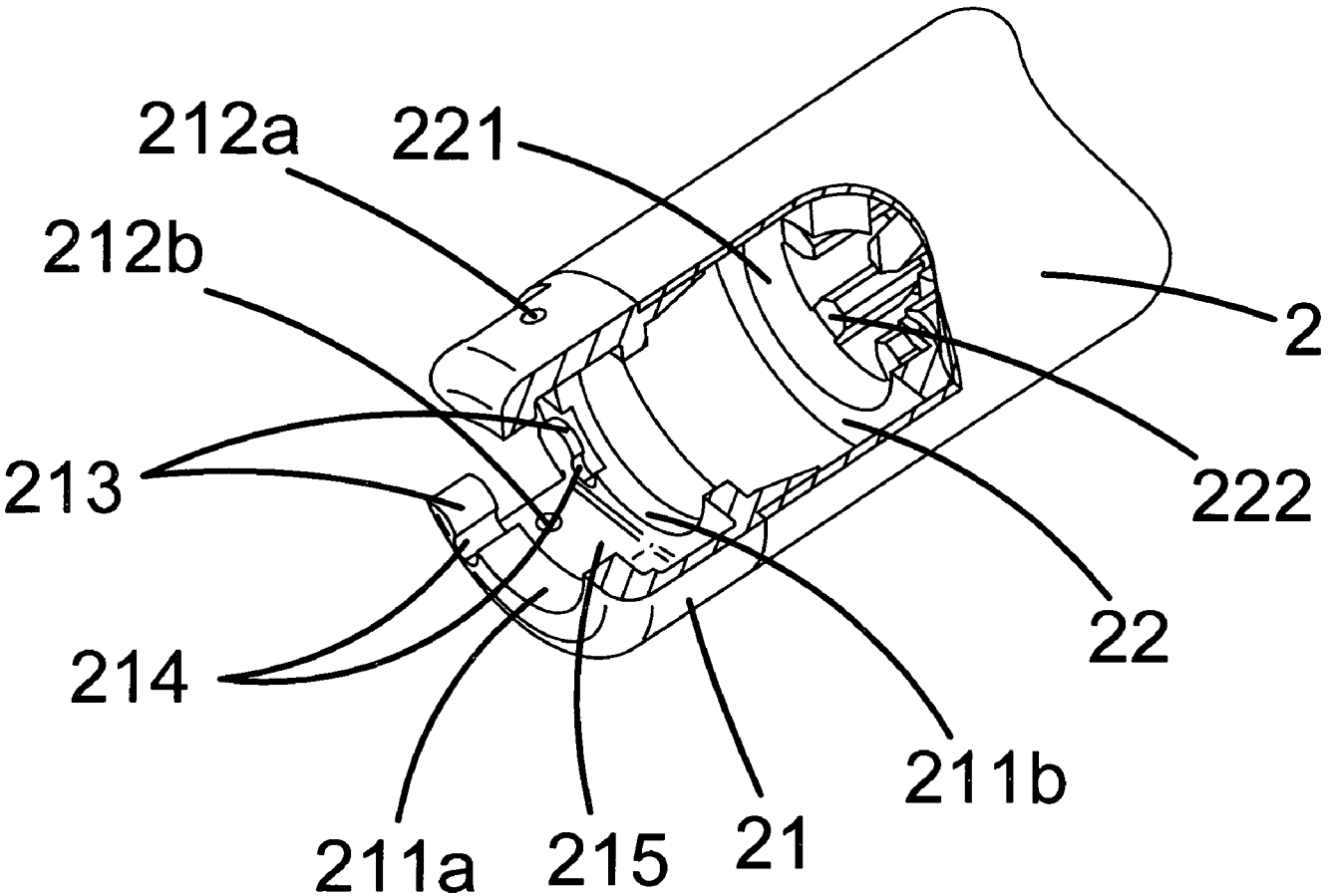
FIG. 4 is an isometric view of a partial quarter section of the suppressor body assembly.

Referring in detail to FIG. 4 of the drawings, suppressor body assembly 2 contains rear support 21 and front support 22. Bores 211*a* and 211*b* thru rear support 21 and bore 221 into front support 22 align flash hider 4 to suppressor body assembly 2. Surface 222 in front support 22 limits the forward travel of flash hider 4 into bore 221. Holes 212*a* and 212*b* accept retaining pins 8*a* (see FIG. 2) and 8*b* (see FIG. 3). Surface 213 in rear support 21 provides a path for protruding surfaces 65 secondary latch 6 (see FIG. 7). At the end of path 213 is cut 214 which provides a ledge that secondary latch 6 must lift over before rotating to unlock. Recess 215 is the left hand receptacle for primary latch 5 (see FIG. 5)

Figure 5:
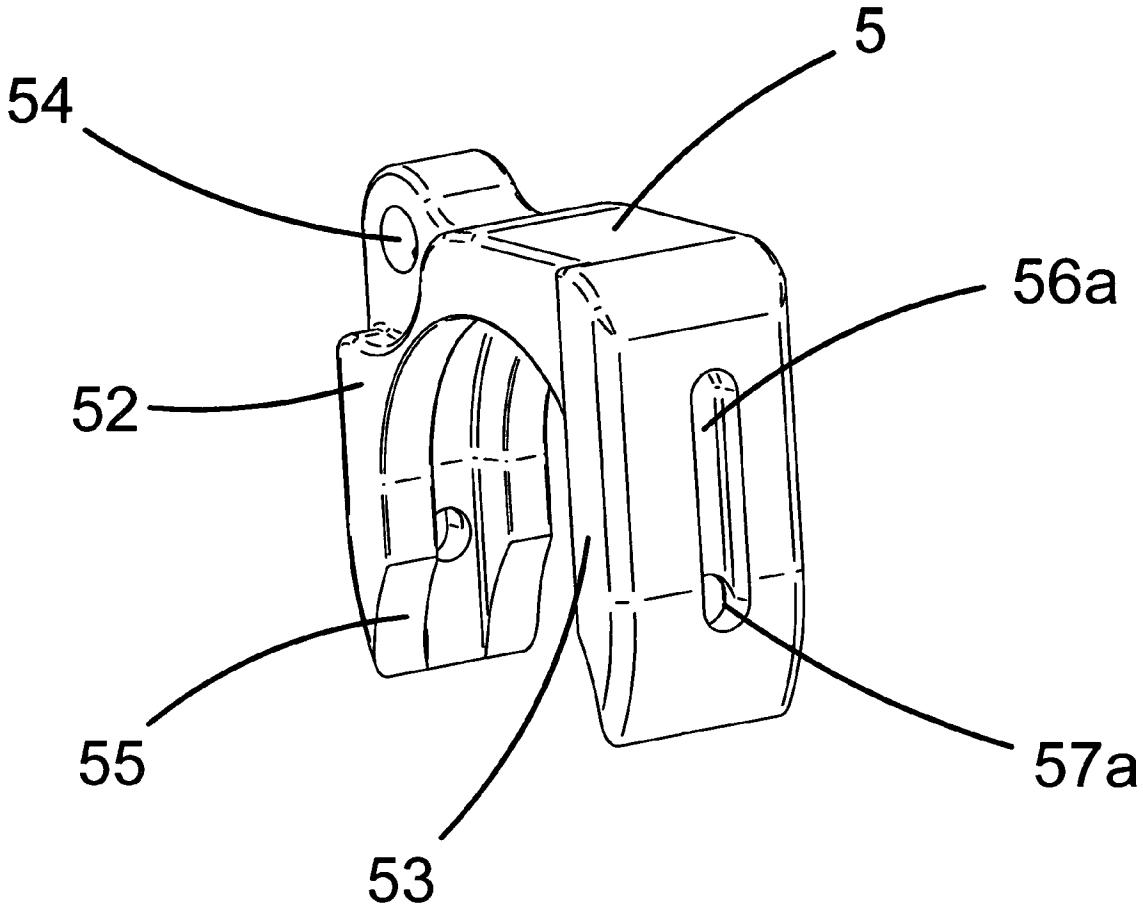
FIG. 5 is an isometric view of the primary latch plate.

Referring in detail to FIG. 5 of the drawings, primary latch plate 5 has left rear face 52 and right rear face 53. Lower bore 55 clears outside diameter 41 of flash hider 4 when primary latch plate 5 is in the unlocked condition. Slot 56*a* clears retaining pin 8*a*. Thru hole 57*a* provides for a disassembly path for retaining pin 8*a*. Hole 54 accepts pivot pin 7.

Referring in detail to FIG. 6 of the drawings, primary latch plate 5 has pocket 59 located between ribs 521 and 522. Slot 56*b* terminates at hole 57*b* which provides for a disassembly path for retaining pin 8*b*. Vertical surface 51 interfaces with wrench flat 45 on flash hider 4 (see FIG. 2) to provide rotational indexing of suppressor assembly 2 relative to the firearm to which it is attached. Ribs 521 and 522 are formed to engage into the twin circular grooves 42 in flash hider 4 (see FIG. 3).

Figure 7:
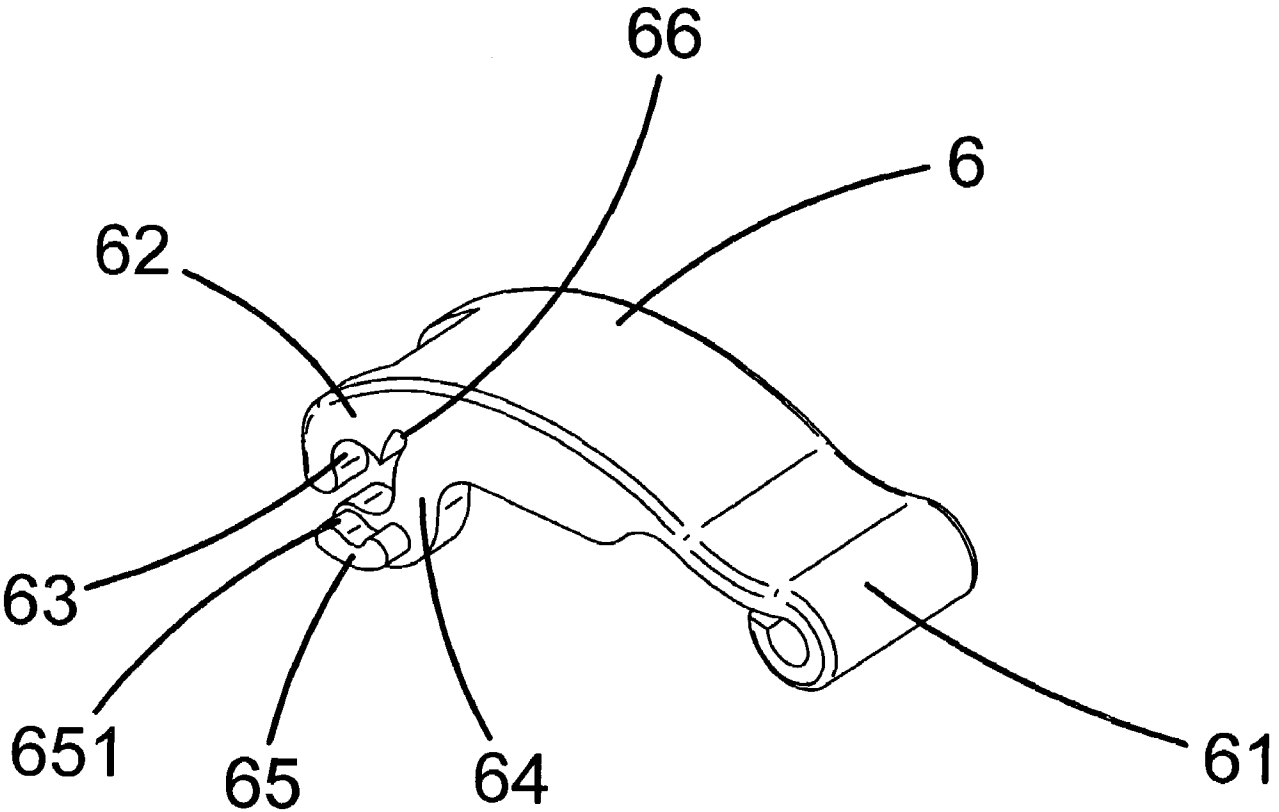
FIG. 7 is an isometric view of the secondary latch in the latched position.

Referring in detail to FIG. 7 of the drawings, secondary latch 6 has a handle end 61, upper leg 62, pivot surface 63, lower arm 64 with protruding lock surface 65 with radius surface 651 which rides on surface 213 of rear support 21 of suppressor assembly 2 (see FIG. 3). Protrusion 65 is contoured so it can snap into recess 214 as secondary latch 6 reaches it full locking rotation about pivot pin 7 thereby increasing the load required to be applied to handle 61 during the initial unlocking rotation of secondary latch 6 from the locked position. Slot 66 separates upper arm 62 and lower arm 64 and allows lower arm 64 to deflect downward as it rotates about surface 213 of rear support 21 thereby applying a downward load on surface 63 against pivot pin 7 which in turn holds primary latch plate 5 in its down most position.

To mount the suppressor to a firearm, the secondary latch 6 is lifted and rotated approximately ninety degrees and at the same time the primary latch plate 5 is lifted upwards until it can no longer move due to the latch retaining pins 8*a* and 8*b*. The suppressor is then slid rearward onto the flash hider 4 until it can no longer move rearward. The primary latch plate 5 is then pushed downwards, engaging both the wrench flat 45 and the two grooves 42 in the flash hider 4. This is achieved through the vertical surface 51 on the primary latch plate and ribs 521 and 522. Once the primary latch plate 5 is in its closed position, secondary latch 6 is then pushed down and then rotated approximately ninety degrees around the pivot pin 7, at the same time applying a downward load against the pivot pin 7 which then holds the primary latch plate in its locked position. Once the latch system is locked, the suppressor is firmly secured to the firearm and at the same time rotationally indexed to the flash hider, limiting the rotational movement of the suppressor to that of tolerances only. The movements involved to mount the suppressor are minimal and require no rotational movement whatsoever. It is a simple matter of lift, slide on, push down and then push down further to secure the secondary latch. This method of attachment is quick and easy to achieve and remember.

To dismount the suppressor from a firearm, the secondary latch 6 is lifted and rotated approximately ninety degrees, and once the secondary latch 6 is unlocked, the primary latch 5 may then be lifted vertically by pulling upward on handle end 61 of secondary latch 6, thereby unlocking the suppressor from the flash hider. To remove the suppressor from the firearm requires a simple pull forward and off the flash hider and firearm. If the suppressor is hot from firing, the minimal thermal contact of the secondary latch with the suppressor allows the user to be able to unlock the suppressor from the flash hider, and then tilt the firearm downwards to enable the hot suppressor to slide off the firearm.

In alternate mounting arrangements, the latch system may also be used to mount suppressors to a firearm in three alternate embodiments. The first is where the barrel has a flash hider machined as part of the barrel. The second is where the barrel of the firearm may also be modified to allow the primary latch to interface with the barrel rather than a flash hider, the modification to the barrel being near the muzzle of the barrel or further rearward to allow attachment of a lengthened sound suppressor that also fits back over the barrel and interfaces with the modified barrel. The third is where the firearm is fitted with an extended length flash hider to allow for attachment of a lengthened sound suppressor that fits back over the barrel and interfaces with the extended length flash hider.

In the first of these alternate embodiments, the barrel of the firearm has a flash hider machined as part of the barrel. A flash hider is machined into the barrel, and duplicates the standard A2 flash hider with two grooves and wrench flats. These allow the latch to attach to the integral flash hider in the same manner as a detachable flash hider.

With the second alternate embodiment, the barrel of the firearm is machined rearward of the muzzle with two grooves and two machined flats that replicate the grooves and flats on the standard A2 flash hider. This allows for a suppressor that has an increased length and that extends back over the barrel to be attached to a firearm thus modified. This embodiment may be used for attachment of sound suppressors to precision shooting rifles such as sniper rifles, where fitting a sound suppressor requires an attachment method that ensures consistent indexing of the suppressor to the same location on the rifle every time the suppressor is attached to the rifle. Precision machining of the grooves and flats will result in much tighter tolerances than is currently available with the mass-produced flash hiders, and this will in turn result in a greater consistent indexing of the suppressor to the rifle. The sound suppressor interfaces with the rifle in two places, the first being the rearward attachment point and the second being a bearing point close to the muzzle of the barrel. The two-point interface helps with providing the consistent indexing of the suppressor to the rifle.

The third alternate embodiment features the use of a lengthened flash hider that extends backwards for use with a suppressor that extends back over the barrel. This embodiment has a flash hider with an integral sleeve extension, and at the rear of the extension there are two grooves and wrench flats that replicate the grooves and flats on the standard A2 flash hider. Again, due to the sound suppressor using a two-point mounting system with a bearing point close to the muzzle of the flash hider, consistent indexing to the same location is achieved.

One of the main problems with suppressors using threads as the method of attachment is that indexing to the same location on the rifle rarely occurs. The latch system, with its indexing feature, ensures that the suppressor returns to the same location every time the suppressor is re-attached to the rifle. This ensures that the POI (Point of Impact) shift is consistent, regardless of whether a mass-produced flash hider is used on the rifle or a precision machined interface on a barrel or extended flash hider is used.

While the invention has been shown and described with reference to a certain specific preferred embodiment, modification may now suggest itself to those skilled in the art. Such modifications and various changes in form and detail may be made herein without departing from the spirit and scope of the invention. Accordingly, it is understood that the invention will be limited only by the appended claims.

The invention claimed is:

1. A sound suppressor mounting system to a firearm having a flash hider, the flash hider having a series of annular grooves and vertical flats on the body of the flash hider, and comprising:

(a) a body;

(b) a primary latch; and (c) a secondary latch;

whereby the body has a bore for receiving the flash hider of the firearm, said bore having a forward support and a rear support and said front support having a surface for limiting the forward travel of the flash hider into the body, and a transverse recess for receiving the primary latch;

the primary latch has at least one rib on the internal surface of the latch, a pivot point, and is movable in a vertical plane to the axis of the bore between an unlatched and a latched position;

the secondary latch has a handle, a pivot surface, a lock surface, and is movable in a vertical plane to the axis of the bore between an unlatched and a latched position; and upon insertion of the flash hider into the body, the primary latch is moved downward to a latched position, the at least one rib on the internal surface of the latch interfaces with a groove on the flash hider, and whereby the secondary latch, upon the primary latch being in the latched position, is then rotated downward around the pivot point on the primary latch to a latched position, thereby locking the primary latch to the body, the body to the flash hider, and the secondary latch to the body.

2. A mounting system according to claim 1, wherein said primary latch has a protruding surface to prevent rotational movement of the sound suppressor when the latch is fully closed, and whereby when said primary latch is moved downward to a latched position, said protruding surface interfaces with said vertical flat on said flash hider.

3. A mounting system according to claim 1, wherein said primary latch has means for providing a biasing of the bore of the body against the outside diameter of the flash hider; and whereby upon insertion of the flash hider into the body, the primary latch is moved downward to a latched position, and whereby there is a biasing of the bore of the body against the outside diameter of the flash hider as the primary latch is pressed downward to a latched position, said biasing compensating for the tolerances of the flash hider.

4. A mounting system according to claim 2, wherein said primary latch has means for providing a biasing of the bore of the body against the outside diameter of the flash hider; and whereby upon insertion of the flash hider into the body, the primary latch is moved downward to a latched position, and whereby there is a biasing of the bore of the body against the outside diameter of the flash hider as the primary latch is pressed downward to a latched position, said biasing compensating for the tolerances of the flash hider.

5. A sound suppressor mounting system to a firearm including a barrel, the barrel having at least one annular groove positioned rearward of the muzzle of the barrel, and comprising:

(a) a body;

(b) a primary latch; and (c) a secondary latch;

whereby the body has a bore for receiving the barrel of the firearm, said bore having a forward support and a rear support and said front support having a surface for limiting the forward travel of the barrel into the body, and a transverse recess for receiving the primary latch;

the primary latch has at least one rib on the internal surface of the latch, a pivot point, and is movable in a vertical plane to the axis of the bore between an un-latched and a latched position;

the secondary latch has a handle, a pivot surface, and a lock surface, and is movable in a vertical plane to the axis of the bore between an unlatched and a latched position; and upon insertion of the barrel into the body, the primary latch is moved downward to a latched position, the at least one rib interfaces with the at least one annular groove, and whereby the secondary latch, upon the primary latch being in the latched position, is then rotated downward around the pivot point on the primary latch to a latched position, thereby locking the primary latch to the body and the body to the barrel, and the secondary latch to the body.

6. A mounting system according to claim 5, wherein said barrel has at least one vertical flat positioned near said at least one annular groove positioned rearward of the muzzle of the barrel, said primary latch has a protruding surface to prevent rotational movement of the sound suppressor when the latch is fully closed, and whereby when said primary latch is moved downward to a latched position, said protruding surface interfaces with said vertical flat on said barrel.

7. A mounting system according to claim 5, wherein said primary latch has means for providing a biasing of the bore of the body against the outside diameter of the barrel; and whereby upon insertion of the barrel into the body, the primary latch is moved downward to a latched position, and whereby there is a biasing of the bore of the body against the outside diameter of the barrel as the primary latch is pressed downward to a latched position, said biasing compensating for the tolerances of the barrel.

8. A mounting system according to claim 6, wherein said primary latch has means for providing a biasing of the bore of the body against the outside diameter of the barrel; and whereby upon insertion of the barrel into the body, the primary latch is moved downward to a latched position, and whereby there is a biasing of the bore of the body against the outside diameter of the barrel as the primary latch is pressed downward to a latched position, said biasing compensating for the tolerances of the barrel.

9. A sound suppressor mounting system to a barrel with an integral flash hider, the barrel having at least one annular groove near the integral flash hider, and comprising:

(a) a body;

(b) a primary latch; and (c) a secondary latch;

whereby the body has a bore for receiving the barrel with integral flash hider, said bore having a forward support and a rear support and said front support having a surface for limiting the forward travel of the barrel with integral flash hider into the body, and a transverse recess for receiving the primary latch;

the primary latch has at least one rib on the internal surface of the latch, a pivot point, and is movable in a vertical plane to the axis of the bore between an un-latched and a latched position;

the secondary latch has a handle, a pivot surface, and a lock surface, and is movable in a vertical plane to the axis of the bore between an unlatched and a latched position; and upon insertion of the barrel with integral flash hider into the body, the primary latch is moved downward to a latched position, the at least one rib on the latch interfaces with the at least one groove on the barrel, and whereby the secondary latch, upon the primary latch being in the latched position, is then rotated downward around the pivot point on the primary latch to a latched position, thereby locking the primary latch to the body, the body to the barrel and integral flash hider, and the secondary latch to the body.

10. A mounting system according to claim 9, wherein said barrel with integral flash hider has at least one vertical flat near the muzzle of the integral flash hider on the barrel, and whereby said primary latch has a protruding surface to prevent rotational movement when the latch is fully closed, and whereby when said primary latch is moved downward to a latched position, said protruding surface interfaces with said vertical flat on said barrel with integral flash hider.

11. A mounting system according to claim 9, wherein said primary latch has means for providing a biasing of the bore of the body against the outside diameter of the barrel with integral flash hider;

and whereby upon insertion of the barrel with integral flash hider into the body, the primary latch is moved downward to a latched position, and whereby there is a biasing of the bore of the body against the outside diameter of the barrel with its integral flash hider as the primary latch is pressed downward to a latched position, said biasing compensating for the tolerances of the barrel with integral flash hider.

12. A mounting system according to claim 10, wherein said primary latch has means for providing a biasing of the bore of the body against the outside diameter of the barrel with integral flash hider;

and whereby upon insertion of the barrel with integral flash hider into the body, the primary latch is moved downward to a latched position, and whereby there is a biasing of the bore of the body against the outside diameter of the barrel with its integral flash hider as the primary latch is pressed downward to a latched position, said biasing compensating for the tolerances of the barrel with integral flash hider.

13. A sound suppressor mounting system for attachment of a sound suppressor to a firearm having an extended length flash hider, the flash hider having an integral rearward extension and the flash hider having at least one annular groove and at least one vertical flat positioned at the rear extension, and comprising (a) a body;

(b) a primary latch; and (c) a secondary latch;

whereby the body has a bore for receiving the extended length flash hider, said bore having a forward support and a rear support and said front support having a surface for limiting the forward travel of the extended length flash hider into the body, and a transverse recess for receiving the primary latch;

the primary latch has at least one rib on the internal surface of the latch, a pivot point, and is movable in a vertical plane to the axis of the bore between an un-latched and a latched position;

the secondary latch has a handle, a pivot surface, and a lock surface, and is movable in a vertical plane to the axis of the bore between an unlatched and a latched position; and upon insertion of the extended length flash hider into the body, the primary latch is moved downward to a latched position, the at least one rib interface with the at least one groove on the extended length flash hider, and whereby the secondary latch, upon the primary latch being in the latched position, is then rotated downward around the pivot point on the primary latch to a latched position, thereby locking the primary latch to the body, the body to the extended length flash hider, and the secondary latch to the body.

14. A mounting system according to claim 13, wherein said extended length flash hider has at least one vertical flat positioned at the rear of the extended length flash hider, and whereby said primary latch has a protruding surface to prevent rotational movement when the latch is fully closed, and whereby when said primary latch is moved downward to a latched position, said protruding surface interfaces with said vertical flat on said extended length flash hider.

15. A mounting system according to claim 13, wherein said primary latch has means for providing a biasing of the bore of the body against the outside diameter of the extended length flash hider;

and whereby upon insertion of the extended length flash hider into the body, the primary latch is moved downward to a latched position, and whereby there is a biasing of the bore of the body against the outside diameter of the extended length flash hider as the primary latch is pressed downward to a latched position, said biasing compensating for the tolerances of the extended length flash hider.

16. A mounting system according to claim 14, wherein said primary latch has means for providing a biasing of the bore of the body against the outside diameter of the extended length flash hider;

and whereby upon insertion of the extended length flash hider into the body, the primary latch is moved downward to a latched position, and whereby there is a biasing of the bore of the body against the outside diameter of the extended length flash hider as the primary latch is pressed downward to a latched position, said biasing compensating for the tolerances of the extended length flash hider.

17. A method of attaching a sound suppressor to a firearm having a flash hider, comprising (a) providing a sound suppressor including a body, a primary latch and a secondary latch;

(b) lifting said primary latch and secondary latch upwards;

(c) placing said sound suppressor onto said flash hider;

(d) pushing said primary latch downward until primary latch is in the closed position; and (e) pushing said secondary latch downward and rotating said secondary latch around a pivot point on said primary latch until said secondary latch is locked.

18. A method of attaching a sound suppressor to a firearm including a barrel, and comprising:

(a) providing a barrel;

(b) machining said barrel to provide a series of annular grooves thereon rearward of the muzzle of the barrel;

(c) providing a sound suppressor including a body, a primary latch and a secondary latch;

(d) lifting said primary latch and secondary latch upwards;

(e) placing said sound suppressor onto said barrel;

(f) pushing said primary latch downward until primary latch is in the closed position; and (g) pushing said secondary latch downward and rotating said secondary latch around a pivot point on said primary latch until said secondary latch is locked.

19. The method according to claim 18, wherein:

during the machining step, at least one vertical flat is machined; said primary latch is provided with a protruding surface and during the pushing the primary latch downward step, the protruding surface interfaces with the at least one vertical flat, and indexes said suppressor to the barrel of the firearm.

20. A method of attaching a sound suppressor to a firearm including a barrel with an integral flash hider, and comprising:

(a) providing a barrel;

(b) machining said barrel to provide a series of annular grooves thereon near the integral flash hider;

(c) providing a sound suppressor including a body, a primary latch and a secondary latch;

(d) lifting said primary latch and secondary latch upwards;

(e) placing said sound suppressor onto said barrel;

(f) pushing said primary latch downward until primary latch is in the closed position; and (g) pushing said secondary latch downward and rotating said secondary latch around a pivot point on said primary latch until said secondary latch is locked.

21. The method according to claim 20, wherein:

during the machining step, at least one vertical flat is machined; said primary latch is provided with a protruding surface and during the pushing the primary latch downward step, the protruding surface interfaces with the at least one vertical flat, and indexes said suppressor to the barrel of the firearm.

22. A method of attaching a sound suppressor to a firearm having an extended length flash hider, the flash hider having an integral rearward extension and the flash hider having a series of annular grooves and vertical flats positioned at the rear of the extension, and comprising:

(a) providing a sound suppressor including a body, a primary latch and a secondary latch;

(b) lifting said primary latch and secondary latch upwards;

(c) placing said sound suppressor onto said extended length flash hider;

(d) pushing said primary latch downward until primary latch is in the closed position; and (e) pushing said secondary latch downward and rotating said secondary latch around a pivot point on said primary latch until said secondary latch is locked.

* * * * *